US007789197B2

(12) United States Patent
Duval et al.

(10) Patent No.: US 7,789,197 B2
(45) Date of Patent: Sep. 7, 2010

(54) SOUNDPROOFING ASSEMBLY, USE FOR SOUNDPROOFING ENCLOSED SPACES, AND METHOD FOR MAKING SAME

(75) Inventors: Arnaud Duval, Gifhorn (DE); Valérie Marcel, Mouzon (FR); Jean-François Rondeau, Carignan (FR); Patrice Charbonnier, Mouzon (FR)

(73) Assignee: Faurecia Automotive Industrie, Nanterre (FR)

( * ) Notice: Subject to any disclaimer, the term of this patent is extended or adjusted under 35 U.S.C. 154(b) by 0 days.

(21) Appl. No.: 11/994,848

(22) PCT Filed: Jul. 7, 2006

(86) PCT No.: PCT/FR2006/001650

§ 371 (c)(1),
(2), (4) Date: Jan. 7, 2008

(87) PCT Pub. No.: WO2007/006950

PCT Pub. Date: Jan. 18, 2007

(65) Prior Publication Data

US 2008/0196971 A1 Aug. 21, 2008

(30) Foreign Application Priority Data

Jul. 7, 2005 (FR) ..... 05 07271

(51) Int. Cl.
*E04B 1/84* (2006.01)

(52) U.S. Cl. ..... 181/290; 181/286; 181/288

(58) Field of Classification Search ..... 181/284, 181/286, 288, 290, 293
See application file for complete search history.

(56) References Cited

U.S. PATENT DOCUMENTS

| | | | | |
|---|---|---|---|---|
| 5,504,281 | A * | 4/1996 | Whitney et al. | 181/286 |
| 6,789,646 | B2 * | 9/2004 | Wang et al. | 181/293 |
| 7,201,253 | B2 * | 4/2007 | Duval et al. | 181/204 |
| 2004/0069564 | A1 | 4/2004 | Wang et al. | |
| 2004/0099476 | A1 * | 5/2004 | Swift et al. | 181/286 |

FOREIGN PATENT DOCUMENTS

| | | | |
|---|---|---|---|
| FR | 2 778 780 | A | 11/1999 |
| GB | 2 163 388 | A | 2/1986 |
| WO | WO 03069596 | A1 * | 8/2003 |

* cited by examiner

*Primary Examiner*—Jeffrey Donels
*Assistant Examiner*—Jeremy Luks
(74) *Attorney, Agent, or Firm*—Young & Thompson

(57) ABSTRACT

A soundproofing assembly includes stacked layers in the form of a first set of layers (36) having good resistance to the passage of air, and a second set of layers (24) with mass-spring function including a layer (28) having a heavy viscoelastic mass and a spring type layer (26); the first set of layers includes a layer (36) of a foam with open cells of high porosity, high tortuosity and good resistance to the passage of air, the layer (36) having, owing to its high tortuosity, excellent sonic absorption properties at medium and high frequencies. The invention is useful for soundproofing motor car passenger compartments.

15 Claims, 2 Drawing Sheets

SOUNDPROOFING ASSEMBLY, USE FOR SOUNDPROOFING ENCLOSED SPACES, AND METHOD FOR MAKING SAME

BACKGROUND OF THE INVENTION

The present invention relates to a soundproofing assembly principally intended for soundproofing of substantially enclosed spaces, such as the passenger compartment of an automobile, application of a foam of plastics material with high tortuosity to such soundproofing, and a method of manufacture of such a soundproofing assembly.

The invention relates to acoustic problems which arise in a substantially enclosed space, such as the passenger compartment of an automobile, in the vicinity of sources of noise such as an engine, the contact of tyres on a road, etc.

Before the description of the prior art it is appropriate to define some terms which are useful for understanding the invention.

In general, in the low frequency range, sound waves undergo a "damping" by materials in the form of single or double sheets (sandwich) or by an effect of porosity and resilience of a mass-spring system, especially using viscoelastic foam.

A soundproofing system ensures an "insulation" when it prevents the entry of medium and high frequency sound waves into the soundproofed space, principally by reflection of the waves towards the noise sources or the exterior of the soundproofed space.

A soundproofing system functions by "sound absorption" (in the range of medium and high frequencies) when the energy of the sound waves is dissipated in an absorbent material.

The invention basically relates to soundproofing in the medium and high frequency range. In general it is relatively simple to obtain good soundproofing at high frequencies with simple means but in the medium frequency range (above all between 400 and 1000 Hz) the problem of soundproofing is all the more acute since the human ear is very sensitive in this frequency range.

Naturally, the different phenomena mentioned above, that is to say damping, insulation and absorption, rarely exist in isolation and they are more often present to varying degrees. Thus the noise in an enclosed space which does not contain sources of noise is the result of contributions from all the sound sources, especially from the engine of an automobile, and from the filtering due to the different actions of the soundproofing material present. Consequently, the soundproofing of an enclosed space is the result of numerous effects, and it is desirable to obtain a good compromise between the soundproofing obtained and the various means implemented for obtaining this soundproofing. For example, it is not necessary to ensure substantial absorption of certain waves in the enclosed space if these have already been practically eliminated by the insulation.

DESCRIPTION OF THE RELATED ART

We will now consider the principal solutions which have been implemented in the past, with reference to FIGS. 1 to 3 of the appended drawings.

FIG. 1 shows an example of a mass-spring system used in a conventional manner in order to provide insulation, especially in the region of the apron which separates the passenger compartment from the engine compartment of an automobile. The reference 10 designates a supporting panel. A layer 12 of a material with a spring effect, such as a foam which may have viscoelastic properties, bears a layer 14 of a material of the "heavy mass" type, that is to say the layer representing the mass of the mass-spring system. Such a mass-spring system is known for the good insulation which it provides. The reference 16 simply designates a layer of decoration which has no functional effect in the case under consideration.

The document GB-2 163 388 describes such a mass-spring system in which the heavy mass part has two layers.

The problem posed by the system represented in FIG. 1 is that, due to its low absorption, the layer 14 forming the heavy mass must have a substantial weight. Thus layers are currently used which have a mass per unit area of the order of 3 to 7 kg/m$^2$. Furthermore, such a system is not very effective in the medium frequency range.

As attempts are made to make automobiles lighter for reasons of reduction of consumption, pollution, etc., a system has been proposed as represented in FIG. 2, for example in the document WO 98/18 657. In this "double permeability" system a porous decoupling layer 18 is in contact with the supporting panel 10, preferably with partial interposition of air, and it has located above it an optional microporous layer 20 for reinforcement and another porous layer 22, optionally with a decorative layer 16. In one example the "heaviest" of the layers is a compressed phenolic felt, and the other is a flexible non-compressed felt. The effect of this system is due to its double permeability, that is to say the difference in permeability between the porous layers. The advantage thereof is that it is light, but the drawback is that it provides practically no insulation: therefore it is not appropriate when such insulation is necessary, for example, for the apron of an automobile.

A complex soundproofing system is also known from the document WO 03/069 596 which comprises two groups of layers, of which a second group 24 of the mass-spring type comprises a layer 28 of the heavy mass type joined to a porous layer which forms a spring 26. This second group constitutes a conventional mass-spring system, but the mass of the heavy layer 28 and the thickness of the layer forming the spring 26 are reduced, for example by one third to one half, relative to the conventional system illustrated in FIG. 1. For example, the layer of the heavy mass type can, instead of having a mass per unit area of 6.5 kg/m$^2$, have a mass per unit area of only 4 kg/m$^2$. This reduction is possible by virtue of the presence of the first group of layers 30.

The first group comprises a porous layer 32, of the acoustic spring type, and an outer layer 34 which has a high resistance to the passage of air, and may also optionally be used as a decorative layer which is effective for soundproofing. This outer layer 34 can be made from a felt having a resistivity to the passage of air of the order of 3 to 20 times higher than that of the other layer 32.

This system therefore constitutes a sort of combination of the two systems described with reference to FIGS. 1 and 2, but with a weight which is clearly reduced relative to the first system due to the lighter weight of the layer 28 of the heavy mass type, and an efficiency which is clearly increased relative to the second system due to the presence of the mass-spring system.

The system shown in FIG. 3 exhibits excellent soundproofing properties because, by its absorption effect especially at medium frequencies, the group of layers 30 compensates for the lower insulating effect provided by the system of the group of layers 24.

The effectiveness of the system of FIG. 3 is offset by its relatively high cost. In fact, manufacture thereof necessitates a method comprising two successive steps carried out in separate installations, which are expensive.

Surprisingly it has been found according to the invention that the absorption effect, especially at medium frequencies, which is obtained with the group of layers 30 according to FIG. 3, that is to say the effect of two superimposed layers having very different resistances to the passage of air, could be obtained with one single layer of foam with special characteristics. These special characteristics are a high porosity and above all a high tortuosity, and these characteristics can be obtained with one single layer of foam.

SUMMARY OF THE INVENTION

The invention therefore relates to the application of such a material to the soundproofing of enclosed spaces, and the application of this material to a soundproofing assembly which functions in a manner analogous to that described with reference to FIG. 3, and in which a mass-spring system is associated with a layer of foam of high tortuosity.

"Tortuosity" is a parameter currently used for characterisation of porous materials. For the description of the different parameters used in order to define the sound absorption phenomena of porous materials, reference may be made to the document "Absorption acoustique dans les milieux poreux", by D. Lafarge, Y. Auregan et al., Communication au Congrès ONERA, Jan. 16, 2003. This document describes especially the effects of viscous friction, inertial mass effects, heat exchange and losses of solids, and it refers to different parameters such as Darcy permeability, tortuosity and viscous characteristic length.

It is known that tortuosity can be measured by determination of the gradient of the curve representing the variation of the square of the index of refraction for the acoustic wavelength used as a function of the inverse of the square root of the frequency. In practice, tortuosity is linked to the form of the circulatory paths in a porous material. Pores which pass in a rectilinear manner through a sheet having parallel faces in a direction perpendicular to these faces have a tortuosity equal to 1. The open-cell foams which are currently used have a tortuosity between 1 and 1.35.

According to the invention, for the single layer which plays the part of the two layers 32 and 34 of the system described with reference to FIG. 3, use is made of a single layer of a foam having a tortuosity greater than 1.4, which may be as high as 3 and is preferably of the order of 2. It is the combination of a high porosity (at least equal to 0.9 and preferably 0.95) and the high tortuosity (greater than 1.4) which give this material these high sound absorbing properties.

More precisely, the invention relates to the use of an open-cell foam of plastics material having a tortuosity greater than 1.4 for soundproofing substantially enclosed spaces.

In this application, this foam advantageously forms a layer associated with a group of layers of the mass-spring type comprising a layer which functions as a viscoelastic heavy mass and a layer which forms a spring.

The invention also relates to a soundproofing assembly comprising superimposed layers of the type which includes a first group of layers having a good resistance to the passage of air and a second group of layers having a mass-spring function, the second group including a layer functioning as a viscoelastic heavy mass and a layer of the spring type; according to the invention the first group of layers comprises a layer of open-cell foam having high porosity, high tortuosity and a good resistance to the passage of air, this layer having due to its high tortuosity excellent sound absorption properties at medium and high frequencies.

The first group of layers preferably only comprises the layer of foam with high tortuosity.

In an advantageous embodiment the layer of foam with high tortuosity is resilient.

The layer with high tortuosity preferably has a porosity higher than 0.9, preferably higher than 0.95.

The layer with high tortuosity preferably has a resistivity to the flow of air between 10 000 and 90 000 $N \cdot s/m^4$, and preferably of the order of 30 000 $N \cdot s/m^4$.

The foam of the layer with high tortuosity is preferably formed from a plastics material chosen from amongst polyurethanes and melamine resins.

The layer of viscoelastic heavy mass preferably has a mass lower by at least one third than the mass of a heavy mass layer of a conventional insulating system having a heavy mass and a spring.

The layer of the spring type of the second group of layers preferably has a tortuosity at most equal to 1.4, and the layer with high tortuosity has a tortuosity between 1.4 and 3, preferably of the order of 2.

In the case where the sources of noise necessitate greater soundproofing in the low frequency range between 200 and 400 Hz it is possible to use for the layer of the spring type a viscoelastic foam (for example with partially closed cells) which has the advantage that it gives structural damping in the range of low frequencies between 200 and 400 Hz and has a loss factor of the order of 0.2 to 0.45, whilst that of the layer with high tortuosity is of the order of 0.1 to 0.2. The reduction in the insulation gradient, that is to say the losses through transmission, of this viscoelastic layer is compensated for by the good insulation gradient of the layer with high tortuosity.

It is advantageous if the soundproofing assembly has a thickness greater than 20 Mm.

The soundproofing assembly can also have a decorative layer on the side where the layer with high tortuosity is located.

The invention also relates to a method of manufacturing a soundproofing assembly comprising superimposed layers, the assembly being of the type which comprises a first group of layers having a good resistance to the passage of air and excellent sound absorption properties at medium and high frequencies, and a second group of layers with a mass-spring function, the second group including a layer which functions as a viscoelastic heavy mass and a layer of the spring type; the method comprises the formation of an initial assembly comprising at least one layer of each of the two groups, and the heating of the assembly obtained, the heating of at least one other layer than those of the initial assembly, the stacking of the initial assembly and the other layer, the arrangement of the stack in a pressing mould, and the joining of the layers by pressing of the stack.

The heating of at least one other layer preferably comprises the heating of a layer of the spring type. The heating of a layer of the spring type preferably comprises the heating of a felt.

The first group of layers preferably comprises one single layer, and the formation of the initial assembly comprises the selection, as layer of the first group, of a layer of open-cell foam which has high porosity and high tortuosity.

BRIEF DESCRIPTION OF THE DRAWING

Other features and advantages of the invention will be better understood by reading the following description of embodiments which is given with reference to the appended drawings, in which.

DESCRIPTION OF THE PREFERRED EMBODIMENTS

Figure 3:
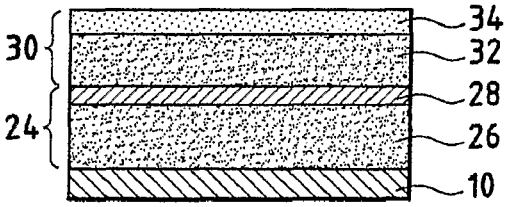
FIG.3 PRIOR ART
Figure 4:
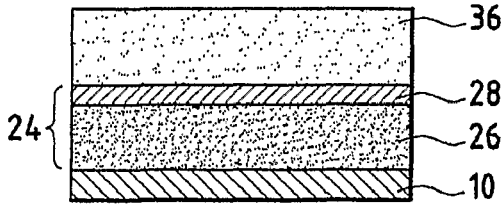
FIG. 4 shows a schematic section through a soundproofing assembly according to the invention disposed on a supporting panel.
Figure 5:
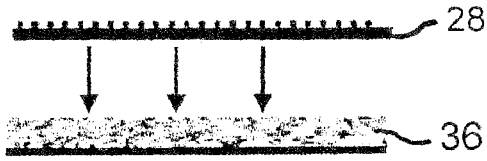
FIGS. 5-8 show sections illustrating the various phases of a method for manufacturing a sound profile assembly according to the invention.
Figure 6:
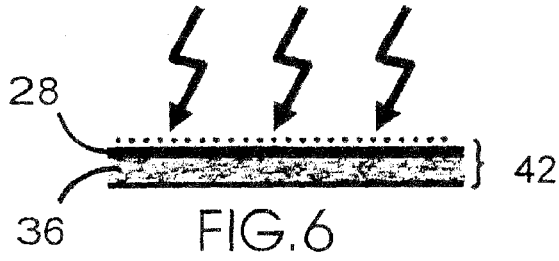
Figure 7:
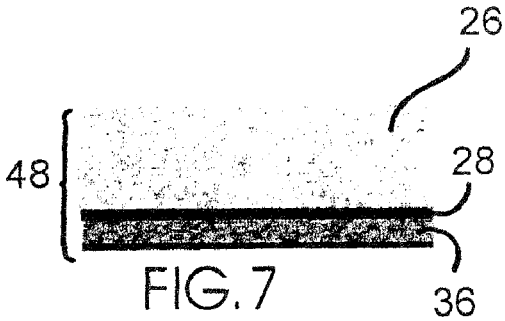

In FIG. 4 the reference 10 designates, as in the other drawings, a panel intended to support the soundproofing assembly according to the invention, for example a apron which separates an engine compartment from a passenger compartment of an automobile. This comprises first of all a second group 24 of layers comprising, as in the system of FIG. 3, a first layer 26 forming a spring and a second layer 28 forming a heavy mass. The first layer 26 forming a spring is a flexible open-cell foam, for example made from thermoplastic material, having good absorption and mechanical decoupling properties. The material of the layer 28, which is impermeable, contains dense materials such as bitumen waste, chalk, barium sulphate, bound by a thermoplastic material, for example a polyolefin such as polyethylene. Other examples of a binder are a vinyl acetate/ethylene copolymer or an ethylene-propylene-diene monomer terpolymer. This assembly may be analogous to that shown in FIG. 3. This second group of layers bears a layer 36 which by itself forms a first group of layers and is formed from a foam of high tortuosity, such as a flexible polyurethane foam having a porosity higher than 0.9 and tortuosity close to 2.

The foam with high porosity and high tortuosity which is used according to the invention is preferably a polyurethane or melamine resin foam. It may be practically rigid, but it is preferably flexible. In an example, such a foam with high tortuosity is produced by manufacture of polyurethane with an isocyanate/polyol ratio clearly higher than the values currently used. These values depend upon each isocyanate-polyol pair. The foam obtained has irregularly distributed pores with complex shapes and bonds. Its porosity is high, that is to say higher than 0.9, and preferably higher than 0.95, this porosity being determined simply by the ratio of the weight of the foam and the weight of the corresponding non-porous material. Its resistivity to the flow of air is high, between 10 000 and 90 000 $N \cdot s/m^4$, and usually of the order of 30 000 $N \cdot s/m^4$. An example of such a foam is obtained with 100 parts of polyether polyol and 65 parts of diphenylmethane diisocyanate.

Consideration will now be given to tests which have been carried out in an installation simulating the apron of an automobile. Assemblies were produced with the systems of FIGS. 1, 3 and 4 having configurations all giving practically equivalent levels of acoustic performance. These levels of performance corresponded to a reduction of noise of 38 dB at 400 Hz, 50 dB at 500 Hz and approximately 57 dB in the range from 800 to approximately 1250 Hz, the reduction being even more considerable at higher frequencies.

Figure 1:
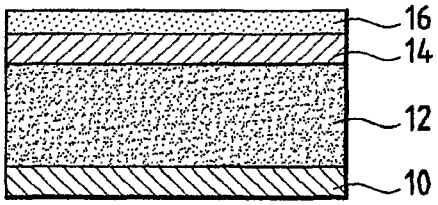
FIG.1 PRIOR ART
FIGS. 1 to 3, already described, show the structures of three known soundproofing systems.

In order to obtain these levels of performance, the system as shown in FIG. 1 (without the decorative layer 16) comprised a layer of polyurethane foam 12 with a thickness of 20 mm, having a mass per unit area of 1.2 $kg/m^2$. The layer 14 of heavy mass had a mass per unit area of 6.5 $kg/m^2$. The weight of a 1 $m^2$ soundproofing element was therefore 7.7 kg.

In the example of FIG. 3, the layer 26 of foam with a spring effect, of the same quality as in the system of FIG. 1, had a thickness of 15 mm and a mass per unit area of 0.9 $kg/m^2$. The layer 28 of heavy mass type had a mass per unit area reduced to 4 $kg/m^2$. Thus the reduction in the mass of the layer was accompanied by a reduction in the thickness of the layer of foam with a spring function. The third layer 32 was formed from a thermoplastic foam identical to that of the layer 26, but with a smaller thickness equal to 7 mm and a mass per unit area equal to 0.49 $kg/m^2$. The outer layer 34 was formed by a felt with a thickness of 5 mm. The mass per unit area of the assembly thus formed was 5.5 $kg/m^2$ In the example having the structure of FIG. 4, the layers 26 and 28 were the same as in the preceding example, and the layer 36 was formed from a polyurethane foam having a tortuosity close to 2, a mass per unit area of 0.6 $kg/m^2$ and a thickness of 10 mm. The mass per unit area of the assembly produced was also 5.5 $kg/m^2$.

In the three embodiments the foams of the layers 12, 26 and 32 were one and the same layer of polyurethane foam with a mass per unit volume of 60 $kg/m^3$.

Thus for identical levels of acoustic performance at medium and high frequencies, the known system described with reference to FIG. 1 had a weight of 7.7 $kg/m^2$, and the systems shown on the one hand in FIG. 3 and on the other hand in FIG. 4 had a weight of 5.5 $kg/m^2$, that is to say a reduction in weight of 28% relative to the system of FIG. 1.

The known system of FIG. 3 necessitates a relatively complex method of manufacture in two steps, because of the necessary arrangement of four layers. In practice, the two successive steps are carried out in separate installations, so that the cost of the assembly obtained thereby is high.

With the system described with reference to the invention, the assembly shown in FIG. 4 (with the exclusion of the panel 10) can be manufactured in one single operation when the foam has been prepared and has only to be put together, or in one single installation in two linked operations, less costly than two separate operations, when the foam with high tortuosity is prepared at the same time.

A description will now be given of one of the methods of manufacture of the soundproofing assembly shown in FIG. 4 in an embodiment of a method according to the invention.

Figure 8:
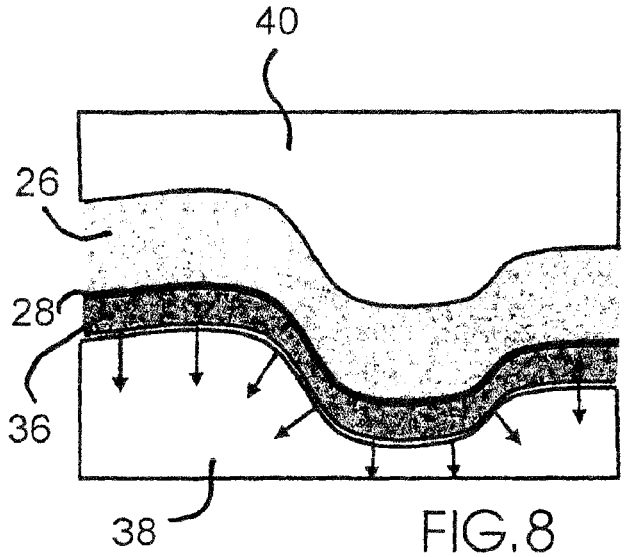
Figure 9:
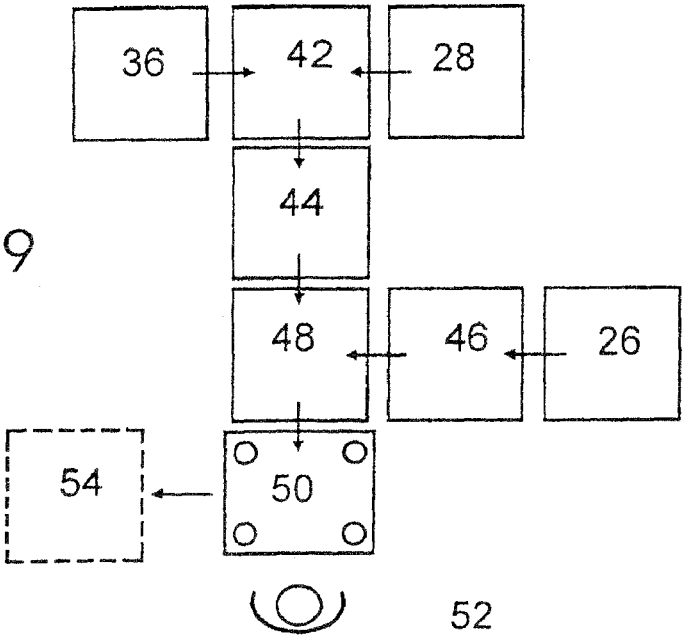
FIG. 9 shows a plan view of an installation enabling the sequence of operations to be carried out.

FIGS. 5 to 8 show sections illustrating the various phases of the method, and FIG. 9 shows a plan view of an installation enabling the sequence of operations to be carried out.

The layer 28 of heavy mass is placed on the layer 36 of foam with high tortuosity in order to form an initial assembly 42. The layer 28 has a fusible material on the side opposite the foam layer 36. The assembly 42 thus obtained is subjected to infrared heating in an infrared furnace 44.

Moreover a felt which forms a spring constituting the layer 26 is subjected to heating in a hot air circulation furnace 46, then it is conveyed in order to form with the initial assembly coming from the furnace 44 a preheated sandwich assembly 48 comprising the two layers 28, 36 heated in the furnace 44 topped by the layer forming a spring 26 which has been heated. The preheated sandwich assembly 48 is conveyed to the mould 38, 40 of a press 50 which is controlled by an operator 52.

As indicated in FIG. 8, the press 50 includes a lower mould 38, which advantageously has vacuum transmission channels, and an upper mould 40.

In the case where the mould 38, 40 used in the press 50 includes an incorporated cutting device, the parts of the desired shape are obtained directly. In the opposite case, the parts coming from the press 50 are conveyed to a cutting device 54.

Although this example of the method has been described in the case where the first layer put in place is the layer 36 with high tortuosity, the method is also very advantageous when the first layer consists of a simple felt.

The advantage of the method described is that it enables the desired parts to be obtained by the use of one single installation comprising one single mould. This arrangement allows a notable reduction in the manufacturing costs.

Thus the described method makes it possible to take advantage of the reduction in weight referred to above. It makes it possible to produce flat or shaped parts. The installation used for carrying it out can also be used in the case of the application of the method to soundproofing assemblies with four layers described above with reference to the aforementioned document WO 03/069596, and the cutting system may or may not be integrated into the installation.

By virtue of the simplified method of manufacture and the lower consumption of materials, (reduction in weight), the soundproofing assemblies according to the invention can be manufactured at a much lower cost than the assemblies shown in FIG. 3, and even a little lower than or at least comparable to the cost of the assemblies shown in FIG. 1.

It may also be noted that the assemblies of the two embodiments of FIGS. 3 and 4 give identical results with structures in which the only difference is the replacement of two layers (32, 34) of FIG. 3 by one single layer (36) of FIG. 4, with practically the same thickness. Therefore it should not be considered that the system of FIG. 4 is a "down-graded" system relative to that of FIG. 3; on the contrary, it constitutes an improvement since for equivalent acoustic results it simplifies the manufacture and significantly reduces the cost.

Finally it will be noted that the manufacture of the soundproofing assemblies produced according to the invention is well suited to the formation of holes adapted to the passage of the elements which have to pass through the assembly, such as the steering column, the brake and accelerator pedals, etc.

Consequently, by virtue of the use of this foam with a high tortuosity, it is possible to obtain properties which are as good as those given by the known system described with reference to FIG. 3, but at a much lower cost than this system.

By comparison with the known system shown in FIG. 1, the reduction in weight is very considerable and therefore corresponds to a reduction in consumption and pollution of the vehicles in which these systems are used.

Figure 2:
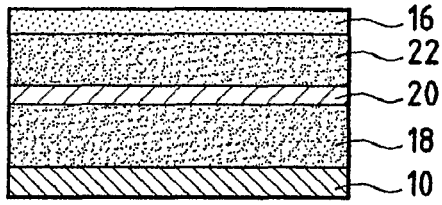
FIG.2 PRIOR ART

By comparison with the system of FIG. 2, the invention gives much better acoustic properties, since the system of FIG. 2 does not enable sufficient insulation to be obtained.

Although reference has been made to the apron of an automobile, the invention has much more extensive applications: in an automobile it is suitable especially for the floor, the roof, any internal surface of the passenger compartment, but it is also suitable in a general manner for any substantially enclosed space which is located in the vicinity of sources of external noise.

The invention claimed is:

1. Soundproofing assembly comprising superimposed layers, of the type which includes:

a first layer (36) having a good resistance to the passage of air, and a second layer, the second layer comprised of a group (24) of layers having a mass-spring function, the second group including a layer (28) functioning as a viscoelastic heavy mass and a layer (26) of the spring type, wherein, the first layer comprises a layer (36) of open-cell foam having high porosity, high tortuosity and a good resistance to the passage of air, this high tortuosity layer (36) having, due to its high tortuosity, excellent sound absorption properties at medium and high frequencies, the soundproofing defines an automobile passenger compartment soundproofing, the first layer (36) comprises only a single layer (36) of foam with high tortuosity, a first side of the first layer (36) is in direct contact with the layer (28) functioning as a viscoelastic heavy mass, and a second side of the first layer (36) is uncovered and exposed.

2. Assembly according to claim 1, wherein the layer (36) of foam with high tortuosity is resilient.

3. Assembly according to claim 1, wherein the layer (36) with high tortuosity has a porosity higher than 0.9.

4. Assembly according to claim 1, wherein the layer (36) with high tortuosity has a resistivity to the flow of air between 10 000 and 90 000 $N \cdot s/m^4$.

5. Assembly according to claim 1, wherein the foam of the layer (36) with high tortuosity is formed from a plastics material chosen from amongst polyurethanes and melamine resins.

6. Assembly according to claim 1, wherein the layer (26) of the spring type of the second group of layers has a tortuosity at most equal to 1.4, and the layer (36) with high tortuosity has a tortuosity between 1.4 and 3.

7. Assembly according to claim 1, wherein the first and second layers have a thickness greater than 20 mm.

8. Assembly according to claim 2, wherein the layer (36) with high tortuosity has a porosity higher than 0.9.

9. Assembly according to claim 1, wherein the foam of the layer (36) with high tortuosity is formed from a plastics material chosen from amongst polyurethanes and melamine resins.

10. Assembly according to claim 1, wherein the layer (26) of the spring type has a tortuosity at most equal to 1.4, and the layer (36) with high tortuosity has a tortuosity between 1.4 and 3.

11. Assembly according to claim 10, wherein the layer (36) with high tortuosity has a tortuosity at most equal to higher than 2 and lower than 3.

12. Assembly according to claim 10, wherein the layer (26) of the spring type has a density lower than 100 $kg/m^3$.

13. Soundproofing assembly comprising superimposed layers, comprising:

a first layer (36) adjacent a second layer (24), the first layer (36) having a good resistance to the passage of air, the first layer comprising a layer (36) of open-cell foam having high porosity, high tortuosity, and a good resistance to the passage of air, the first layer (36) having a porosity higher than 0.9, the first layer (36) having a tortuosity between 2 and 3, the first layer (36) having, due to its high tortuosity, excellent sound absorption properties at medium and high frequencies, the soundproofing defining an automobile passenger compartment soundproofing, the second layer comprised of a group (24) of layers having a mass-spring function, the second group including i) a layer (28) functioning as a viscoelastic heavy mass, and ii) a layer (26) of the spring type, and the layer (26) of the spring type having a tortuosity at most equal to 1.4.

14. Assembly according to claim 13, wherein the layer (36) of foam with high tortuosity is resilient.

15. Assembly according to claim 13, wherein the layer (36) with high tortuosity has a resistivity to the flow of air between 10 000 and 90 000 $N \cdot s/m^4$.

* * * * *